US006381763B1

(12) United States Patent
Schneider

(10) Patent No.: US 6,381,763 B1
(45) Date of Patent: May 7, 2002

(54) PLUNGER FOR CLEARING A CLOGGED DRAIN

(76) Inventor: Wallace Schneider, 41 W. 72nd St., 8A, New York, NY (US) 10023-3483

( * ) Notice: Subject to any disclaimer, the term of this patent is extended or adjusted under 35 U.S.C. 154(b) by 0 days.

(21) Appl. No.: 09/813,211

(22) Filed: Mar. 20, 2001

(51) Int. Cl.[7] ..... E03D 9/00
(52) U.S. Cl. ..... 4/255.11
(58) Field of Search ..... 4/255.05, 255.11, 4/255.12

(56) References Cited

U.S. PATENT DOCUMENTS 186,206 A * 1/1877 Hawley ..... 4/255.11
1,673,447 A * 6/1928 Fiedler ..... 4/255.11
3,336,604 A * 8/1967 Lacey et al. ..... 4/255.11
3,644,943 A * 2/1972 Parodic fu Leonardo et al. ..... 4/255.11
4,622,702 A 11/1986 Allen ..... 4/255
5,099,527 A * 3/1992 Roose ..... 4/255.11
5,974,596 A * 11/1999 Strzok ..... 4/255.11

* cited by examiner

*Primary Examiner*—Charles E. Phillips
(74) *Attorney, Agent, or Firm*—Richard L. Miller

(57) ABSTRACT

A plunger for clearing a clogged drain. The plunger includes a cup, a user-gripping handle, and a water-shielding cap. The cup is resiliently collapsible and has an uppermost wall with air-escaping throughbores that allow air trapped in the cup to escape therethrough when the cup is driven downwardly over the clogged drain so as to increase hydraulic efficiency of water in the clogged drain. The user-gripping handle extends upwardly from the cup. The water-shielding cap is attached to the user-gripping handle, just above the cup. The diameter of the water-shielding cap is such so as to allow the water-shielding cap to extend radially outwardly past the air-escaping throughbores so as to shield a user from the water escaping with the air when the cup is driven downwardly over the clogged drain.

18 Claims, 1 Drawing Sheet

PLUNGER FOR CLEARING A CLOGGED DRAIN

BACKGROUND OF THE INVENTION

1. Field of the Invention

The present invention relates to a plunger. More particularly, the present invention relates to a plunger for clearing a clogged drain.

2. Description of the Prior Art

Numerous innovations for drain plungers have been provided in the prior art. Even though these innovations may be suitable for the specific individual purposes to which they address, however, they differ from the present invention.

For example, U.S. Pat. No. 4,622,702 to Allen teaches an improved plunger for clearing clogged bathroom drains and the, like. The plunger has apertures through the wall of its resiliently collapsible cup and a diaphragm or other occlusion member on the inside surface of the cup for alternately opening and partially occluding the apertures in response to pressures and liquid flow. The invention allows repetitive application of downward hydraulic pressure on the clog without excessive reverse pressures during the intervening upward strokes, facilitates variation in the degree of hydraulic pressure applied, and provides several related advantages. In one preferred embodiment, the diaphragm is secured to a raised portion of the cup inside surface. In another, the degree of maximum occlusion is adjustable by turning the occlusion member. In yet another, the cup and diaphragm are integrally formed.

SUMMARY OF THE INVENTION

Accordingly, an object of the present invention is to provide a plunger for clearing a clogged drain that avoids the disadvantages of the prior art.

Another object of the present invention is to provide a plunger for clearing a clogged drain that is simple and inexpensive to manufacture.

Still another object of the present invention is to provide a plunger for clearing a clogged drain that is simple to use.

Briefly stated, still yet another object of the present invention is to provide a plunger for clearing a clogged drain. The plunger includes a cup, a user-gripping handle, and a water-shielding cap. The cup is resiliently collapsible and has an uppermost wall with air-escaping throughbores that allow air trapped in the cup to escape therethrough when the cup is driven downwardly over the clogged drain so as to increase hydraulic efficiency of water in the clogged drain. The user-gripping handle extends upwardly from the cup. The water-shielding cap is attached to the user-gripping handle, just above the cup. The diameter of the water-shielding cap is such so as to allow the water-shielding cap to extend radially outwardly past the air-escaping throughbores so as to shield a user from the water escaping with the air when the cup is driven downwardly over the clogged drain.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
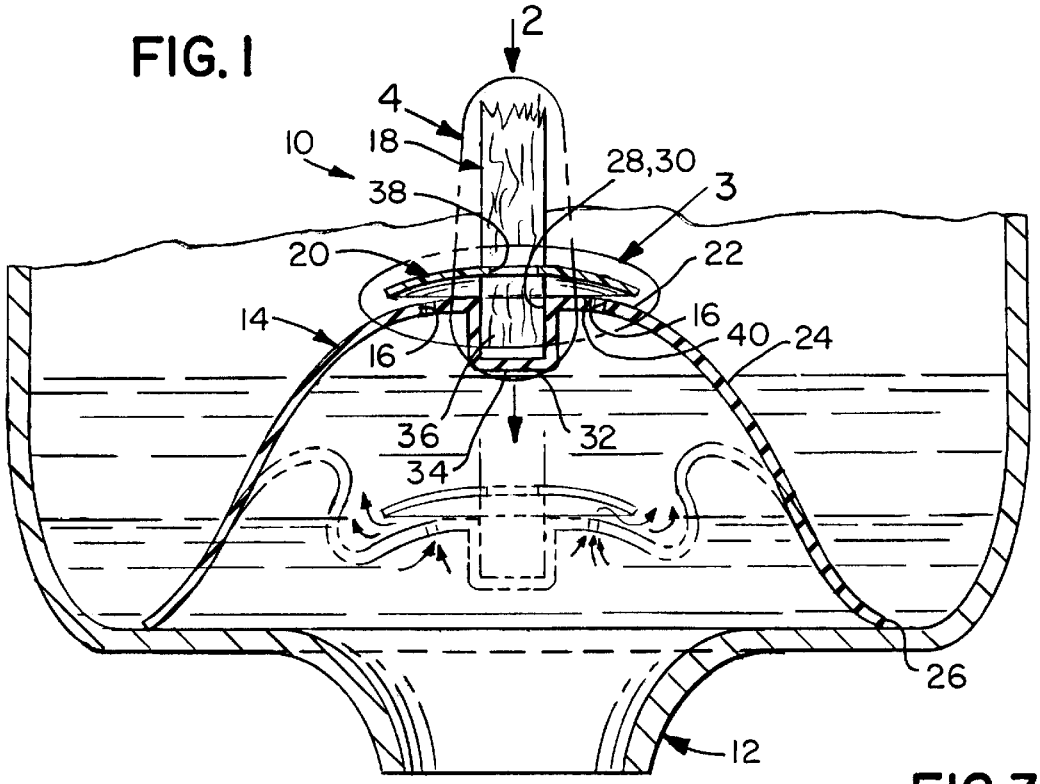
FIG. 1 is a diagrammatic cross sectional view of the present invention in use.

10 plunger of present invention for clearing clogged drain 12
12 clogged drain
14 cup for engaging clogged drain 12
16 air-escaping throughbores through cup 14 for allowing air trapped in cup 14 to escape therethrough when cup 14 is driven downwardly over clogged drain 12 so as to increase hydraulic efficiency of water in clogged drain 12
18 user-gripping handle
20 water-shielding cap
22 top wall of cup 14
24 side wall of cup 14
26 bottom of cup 14
28 handle-receiving throughbore through top wall 22 of cup 14
30 perimeter defining handle-receiving throughbore 28 through top wall 22 of cup 14
32 handle-receiving cup of top wall 22 of cup 14
34 closed bottom of handle-receiving cup 32 of top wall 22 of cup 14
36 cup-engaging end of user-gripping handle 18
38 cap-receiving groove in user-gripping handle 18
40 bottom of water-shielding cap 20
42 handle-receiving throughbore through water-shielding cap 20
44 perimeter defining handle-receiving throughbore 42 through water-shielding cap 20

DETAILED DESCRIPTION OF THE PREFERRED EMBODIMENT

Referring now to the figures, in which like numerals indicate like parts, and particularly to FIG. 1, the plunger of the present invention is shown generally at 10 plunger for clearing a clogged drain 12.

Figure 3:
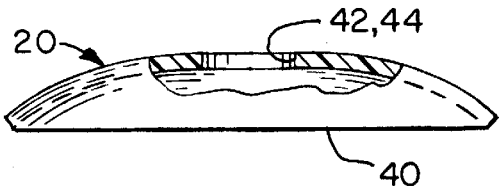
FIG. 3 is an enlarged diagrammatic side elevational view of the area generally enclosed by he dotted curve identified by arrow 3 in FIG. 1 of the cap of the present invention.
Figure 2:
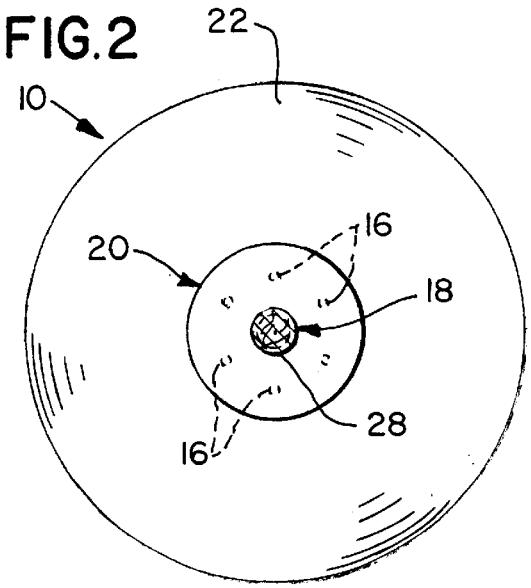
FIG. 2 is a reduced diagrammatic top plan view taken generally in the direction of arrow 2 in FIG. 1.
Figure 4:
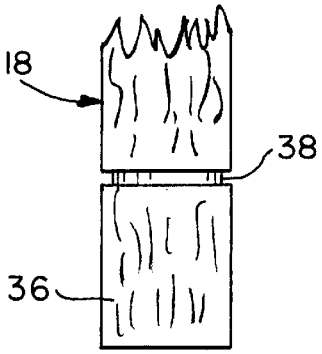
FIG. 4 is an enlarged diagrammatic side elevational view of the area generally enclosed by he dotted curve identified by arrow 4 in FIG. 1 of the handle of the present invention.

The configuration of the plunger 10 can best be seen in FIGS. 1–3, and as such, will be discussed with reference thereto.

The plunger 10 comprises a cup 14 that is resiliently collapsible and has air-escaping throughbores 16 therethrough, and for engaging the clogged drain 12, and a user-gripping handle 18 that extends upwardly from the cup 14.

The plunger 10 further comprises a water-shielding cap 20 that is attached to the user-gripping handle 18, above the cup 14.

The cup 14 is bell-shaped and hollow.

The cup 14 has a top wall 22 that is circular-shaped and horizontally-oriented, and a side wall 24 that is frusto-conically-shaped and depends from the top wall 22 thereof to a bottom 26 thereof that is open.

The top wall 22 of the cup 14 has a handle-receiving throughbore 28 that is circular-shaped, centrally-disposed, and defined by a perimeter 30.

The top wall 22 of the cup 14 further has a handle-receiving cup 32 that is cylindrically-shaped.

The handle-receiving cup 32 of the top wall 22 of the cup 14 depends from the perimeter 30 of the handle-receiving throughbore 28 therein, to a closed bottom 34.

The top wall 22 of the cup 14 further has the air-escaping throughbores 16 extending vertically therethrough for allowing air trapped in the cup 14 to escape therethrough when the cup 14 is driven downwardly over the clogged drain 12 so as to increase hydraulic efficiency of water in the clogged drain 12.

The air-escaping throughbores 16 in the top wall 22 of the cup 14 are equally-spaced-apart from adjacent ones thereof.

Each air-escaping throughbore 16 in the top wall 22 of the cup 14 is circular-shaped.

The air-escaping throughbores 16 in the top wall 22 of the cup 14 are positioned circumferentially around in a circular pattern, but spaced outboard of, and do not communicate with, the handle-receiving throughbore in the top wall 22 of the cup 14.

The user-gripping handle 18 is slender, elongated, rod-shaped, and vertically-oriented.

The user-gripping handle 18 has a cup-engaging end 36 that snugly fills the handle-receiving cup 32 in the top wall 22 of the cup 14 so as to attach the user-gripping handle 18 to the cup 14.

The user-gripping handle 18 further has a cap-receiving groove 38 that is circular-shaped, horizontally-oriented, and extends completely circumferentially therearound.

The cap-receiving groove 38 in the user-gripping handle 18 is disposed Just above the top wall 22 of the cup 14.

The water-shielding cap 20 is substantially hemispherically-shaped and horizontally-oriented.

The water-shielding cap 20 has a bottom 40 that is open and has a diameter.

The water-shielding cap 20 further has a handle-receiving throughbore that extends centrally therethrough and is defined by a perimeter 44.

The user-gripping handle 18 extends through the handle-receiving throughbore 42 in the water-shielding cap 20, with the perimeter 44 of the handle-receiving throughbore 42 in the water-shielding cap 20 engaging in the cap-receiving groove 38 in the user-gripping handle 18 so as to attach the water-shielding cap 20 to, and prevent movement relative to, the user-gripping handle 18.

The diameter of the bottom 40 of the water-shielding cap 20 is such so as to allow the water-shielding cap 20 to extend radially outwardly past the air-escaping throughbores 16 in the top wall 22 of the cup 14 for shielding a user from the water escaping with the air when the cup 14 is driven downwardly over the clogged drain 12.

It will be understood that each of the elements described above, or two or more together, may also find a useful application in other types of constructions differing from the types described above.

While the invention has been illustrated and described as embodied in a plunger for clearing a clogged drain, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A plunger for clearing a clogged drain, comprising:

a) a cup being resiliently collapsible and having air-escaping throughbores therethrough, and for engaging the clogged drain; and b) a user-gripping handle extending upwardly from said cup; further comprising a water-shielding cap attached to said user-gripping handle, above said cup, wherein said cup has:

i) a top wall that is circular-shaped and horizontally-oriented; and ii) a side wall that is frusto-conically-shaped and depends from said top wall thereof to a bottom thereof that is open, wherein said user-gripping handle further has a cap-receiving groove that is circular-shaped, horizontally-oriented, and extends completely circumferentially therearound.

2. The plunger as defined in claim 1, wherein said cap-receiving groove in said user-gripping handle is disposed just above said top wall of said cup.

3. The plunger as defined in claim 1, wherein said cup is bell-shaped and hollow.

4. The plunger as defined in claim 1, wherein said water-shielding cap is substantially hemispherically-shaped, and horizontally-oriented.

5. The plunger as defined in claim 1, wherein said top wall of said cup has a handle-receiving throughbore.

6. The plunger as defined in claim 5, wherein said handle-receiving throughbore in said top wall of said cup is circular-shaped, centrally-disposed, and defined by a perimeter.

7. The plunger as defined in claim 6, wherein said top wall of said cup further has a handle-receiving cup that is cylindrically-shaped.

8. The plunger as defined in claim 7, wherein said handle-receiving cup of said top wall of said cup depends from said perimeter of said handle-receiving throughbore therein, to a closed bottom.

9. The plunger as defined in claim 7, wherein said user-gripping handle has a cup-engaging end that snugly fills said handle-receiving cup in said top wall of said cup so as to attach said user-gripping handle to said cup.

10. The plunger as defined in claim 5, wherein said top wall of said cup further has said air-escaping throughbores extending vertically therethrough for allowing air trapped in said cup to escape therethrough when said cup is driven downwardly over the clogged drain so as to increase hydraulic efficiency of water in the clogged drain.

11. The plunger as defined in claim 10, wherein said air-escaping throughbores in said top wall of said cup are equally-spaced-apart from adjacent ones thereof.

12. The plunger as defined in claim 10, wherein said air-escaping throughbores in said top wall of said cup are positioned circumferentially around in a circular pattern, but spaced outboard of, and do not communicate with, said handle-receiving throughbore in said top wall of said cup.

13. The plunger as defined in claim 10, wherein said water-shielding cap has a bottom that is open and has a diameter.

14. The plunger as defined in claim 13, wherein said diameter of said bottom of said water-shielding cap is such so as to allow said water-shielding cap to extend radially outwardly past said air-escaping throughbores in said top wall of said cup for shielding a user from the water escaping with the air when said cup is driven downwardly over the clogged drain.

15. The plunger as defined in claim 1, wherein each air-escaping throughbore is circular-shaped.

16. The plunger as defined in claim 1, wherein said user-gripping handle is slender, elongated, rod-shaped, and vertically-oriented.

17. The plunger as defined in claim 1, wherein said water-shielding cap has a handle-receiving throughbore that extends centrally therethrough and is defined by a perimeter.

18. The plunger as defined in claim 17, wherein said user-gripping handle extends through said handle-receiving throughbore in said water-shielding cap, with said perimeter of said handle-receiving throughbore in said water-shielding cap engaging in said cap-receiving groove in said user-gripping handle so as to attach said water-shielding cap to, and prevent movement relative to, said user-gripping handle.

* * * * *